US006857774B2

(12) United States Patent
Kozyuk

(10) Patent No.: US 6,857,774 B2
(45) Date of Patent: Feb. 22, 2005

(54) DEVICES FOR CAVITATIONAL MIXING AND PUMPING AND METHODS OF USING SAME

(75) Inventor: Oleg V. Kozyuk, Westlake, OH (US)

(73) Assignee: Five Star Technologies, Inc., Cleveland, OH (US)

( * ) Notice: Subject to any disclaimer, the term of this patent is extended or adjusted under 35 U.S.C. 154(b) by 0 days.

(21) Appl. No.: 10/211,941

(22) Filed: Aug. 2, 2002

(65) Prior Publication Data

US 2004/0022122 A1 Feb. 5, 2004

(51) Int. Cl.[7] ..... B01F 5/12; B01F 7/16
(52) U.S. Cl. ..... 366/263; 366/336
(58) Field of Search ..... 366/265, 262, 366/263, 336

(56) References Cited

U.S. PATENT DOCUMENTS

| | | | | |
|---|---|---|---|---|
| 780,260 | A | | 1/1905 | Beemer |
| 865,030 | A | | 9/1907 | Forbes |
| 1,338,996 | A | | 5/1920 | Norcross |
| 1,417,883 | A | | 5/1922 | Beers |
| 2,541,221 | A | | 2/1951 | Edwards |
| 2,588,591 | A | | 3/1952 | Thompson |
| 2,609,189 | A | | 9/1952 | Derina |
| 2,626,135 | A | | 1/1953 | Serner |
| 2,645,464 | A | | 7/1953 | Forbes |
| 2,673,075 | A | | 3/1954 | Borck |
| 2,985,389 | A | | 5/1961 | Willems |
| 3,128,084 | A | | 4/1964 | Castor |
| 3,273,865 | A | | 9/1966 | White |
| 3,414,245 | A | | 12/1968 | Frazer |
| 3,486,741 | A | | 12/1969 | Midgette |
| 3,690,621 | A | | 9/1972 | Tamaka et al. |
| 3,820,759 | A | * | 6/1974 | Hege ..... 366/265 |
| 3,953,004 | A | | 4/1976 | Schmidt et al. |
| 3,961,775 | A | | 6/1976 | Markus |
| 4,021,349 | A | | 5/1977 | Kaelin |
| 4,283,357 | A | | 8/1981 | Sidery |
| 4,339,206 | A | | 7/1982 | Ahs |
| 4,416,548 | A | | 11/1983 | Carre et al. |
| 4,451,155 | A | | 5/1984 | Weber et al. |
| 5,226,727 | A | | 7/1993 | Reichner |
| 5,628,616 | A | | 5/1997 | Lee |
| 6,035,897 | A | * | 3/2000 | Kozyuk ..... 366/336 |
| 6,132,080 | A | | 10/2000 | Gurth |
| 6,168,307 | B1 | * | 1/2001 | Venans ..... 366/262 |
| 6,280,078 | B1 | | 8/2001 | Lewis |
| 6,312,216 | B1 | | 11/2001 | Falcimaigne |
| 6,354,729 | B1 | * | 3/2002 | Brown ..... 366/304 |
| 6,616,325 | B1 | * | 9/2003 | Brown ..... 366/262 |

FOREIGN PATENT DOCUMENTS

| | | | |
|---|---|---|---|
| GB | 2308076 | * | 6/1997 |
| WO | WO 00/59617 | * | 10/2000 |

* cited by examiner

*Primary Examiner*—Tony G. Soohoo
(74) *Attorney, Agent, or Firm*—Benesch, Friedlander, Coplan & Aronoff LLP

(57) ABSTRACT

The present invention provides for a cavitational mixing and/or pumping device and method including a body having a base portion and a peripheral wall extending from the base portion and defining an inlet space therebetween. Additionally, the base portion includes at least one inlet port disposed therein that is in fluid communication with the inlet space. The peripheral wall includes an outlet channel disposed therein that is in fluid communication with the inlet space. A cavitation assembly is disposed within the outlet channel. Alternatively, a plurality of cavitation assemblies may be disposed within the outlet channel.

10 Claims, 11 Drawing Sheets

DEVICES FOR CAVITATIONAL MIXING AND PUMPING AND METHODS OF USING SAME

BACKGROUND OF THE INVENTION

The present invention relates generally to a device and method of cavitational mixing. However, it finds particular application in both mixing and pumping applications and will be described with particular reference thereto.

Up to the present time, it is well known that there are many chemical reactions that essentially alter the speed and yield of finished products under the influence of ultrasonic oscillation.

There also exists a great quantity of chemical reactions and mixing that may only proceed under the influence of ultrasonic oscillation. Similar reactions may be accomplished in aqueous as well as non-aqueous, liquid-based media. The main requirement for the realization of similar reactions is the imposition of ultrasonic oscillations on the liquid medium. All of these chemical reactions relate to the class of sonochemical reactions. As determined through many years of investigation and numerous research studies (Timothy J. Mason, "Advances in Sonochemistry", Volume 3. 1993. 292 pp., JAI Press Inc.), the sources of initiation of sonochemical reactions appear as cavitation bubbles which arise in liquid-based media during diffusion within by ultrasonic oscillations.

During the collapse of the cavitation bubbles, very high localized pressures and temperatures are achieved. According to some estimations the temperature within the bubbles attains a magnitude in the order of 5000° C. and pressure of approximately 500 kg/cm$^2$ (K. S. Suslick, Science, Vol. 247, Mar. 23, 1990, pgs. 1439–1445). These high temperatures and pressures stimulate the progress of various chemical reactions such as in the gaseous phase within the bubble as well as in the gaseous phase on the surface of the bubble.

Common for all sonochemical reactions and processes is that, for the creation of cavitation bubbles in a liquid-based medium, the principle of application of ultrasonic oscillations on the liquid-based medium is used. The basic equipment which is used in sonochemistry appear as ultrasonic devices of various designs.

This method of conducting sonochemical reactions is sufficiently effective for processing small volumes of liquids and has found its chief application on the level of laboratory research. Transitioning to large scale volumes, however, which are used in industry, is significantly difficult and even at times impossible. This is associated with the problems which arise during the scaling up of cavitation that is produced with the aid of ultrasonic oscillations.

It is possible to avoid these shortcomings, however, by producing the quality of the initiator of sonochemical reactions, cavitation bubbles, through the course of hydrodynamics. An example of using hydrodynamic cavitation for conducting sonochemical reactions is presented in the work of: Pandit A. B., Moholkar V. S., "Harness Cavitation to Improve Processing," Chemical Engineering Progress, July 1996, pgs. 57–69.

However, the aforementioned example method of realizing sonochemical reactions with the aid of hydrodynamic cavitation is not effective. As noted by the authors themselves, one of the problems they uncovered was the ineffective utilization of the energy in the hydrodynamic flow. Utilization of non-optimal regimes of hydrodynamic cavitation leads to a decrease in the intensity of sonochemical reactions and increases the degree of heating the medium.

In the present invention, the proposed method of conducting sonochemical reactions and processes, particularly in large scale volumes of liquid-based media, allows the utilization of optimal hydrodynamic cavitation regimes and also reduces the energy consumption for conducting the processes.

The present invention contemplates a new and improved method and apparatus for conducting sonochemical reactions and processes, particularly in large scale volumes of liquid based media, using the optimal hydrodynamic cavitation regimes and reducing the energy consumption for conducting the processes, which is simple in design, effective in use, and overcomes the foregoing difficulties and others while providing better and more advantageous overall results. Specifically, the present invention relates to utilizing cavitation in large scale volumes for both mixing and pumping applications.

SUMMARY OF THE INVENTION

The present invention overcomes problems in the prior art and others.

The present invention provides for a mixing device including a body having a base portion and a peripheral wall extending from the base portion and defining an inlet space therebetween. Additionally, the base portion includes at least one inlet port disposed therein that is in fluid communication with the inlet space. The peripheral wall includes an outlet channel disposed therein that is in fluid communication with the inlet space. A cavitation assembly is disposed within the outlet channel. Alternatively, a plurality of cavitation assemblies may be disposed within the outlet channel.

The cavitation assembly may include a baffle body that creates a local constriction between the baffle body and the outlet channel. Alternatively, the cavitation assembly may include at least two baffle bodies connected in series that create at least two local constrictions between the baffle bodies and the outlet channel of each of the baffle bodies.

Further, the present invention may include a shaft, and means for rotating (i.e. motor) the shaft connected coaxial to the base portion of the body opposite the peripheral wall. In this embodiment, the body has a generally cylindrical shape.

In another embodiment, the present invention provides for a device for mixing fluid comprising a body wherein the body includes a base portion and a peripheral wall extending from the base portion and defining an inlet space therebetween. The base portion includes at least one inlet port disposed therein that is in fluid communication with the inlet space. The peripheral wall includes an outlet channel disposed therein that is in fluid communication with the inlet space and a means for creating cavitation disposed within the outlet channel.

The means for creating cavitation may be a baffle body that creates a local constriction between the baffle body and the outlet channel thereby effectuating cavitational mixing downstream from the baffle body. Alternatively, the means for creating cavitation may include at least two baffle bodies connected in series that create at least two local constrictions between the baffle bodies and the outlet channel thereby effectuating cavitational mixing downstream from each of the baffle bodies.

In another embodiment, the present invention provides for a method for mixing a fluid comprising the steps of first providing an agitator head assembly into a volume of fluid, where the agitator head assembly comprises (i) a base portion and a peripheral wall extending from the base portion defining an inlet space therebetween, the base portion includes at least one inlet port disposed therein which is in fluid communication with the inlet space, the peripheral wall includes an outlet channel disposed therein which is in fluid communication with the inlet space; and (ii) a cavitation assembly disposed within the outlet channel. The next step is rotating the agitator head assembly to create centrifugal forces thereby forcing the fluid through the cavitation assembly. Finally, creating cavitation when the fluid passes through the cavitation assembly thereby effectuating mixing of the fluid.

Another embodiment of the present invention provides for a device having pumping and mixing capabilities. This alternate embodiment comprises (i) a housing having an inlet for supplying a liquid and an outlet; (ii) an agitator head assembly having a base portion and a peripheral wall extending from the base portion defining an inlet space therebetween and disposed within the housing. The peripheral wall includes an outlet channel disposed therein that is in fluid communication with the inlet space. The inlet space is in fluid communication with the inlet of the housing, (iii) means for creating cavitation disposed within the outlet channel; and (iv) means for rotating the agitator head assembly within the housing.

In this embodiment the means for creating cavitation may be a baffle body coaxially disposed in the outlet channel to provide a local constriction between the baffle body and the outlet channel. Alternatively, the means for creating cavitation may be a plurality of baffle bodies coaxially disposed in series in the outlet channel to provide a local constriction between the baffle bodies and the outlet channel. The inlet orifice in this embodiment may be disposed perpendicular to said outlet orifice. Additionally, the rotating means may be a motor.

Another embodiment of the present invention provides for a method for mixing and pumping a liquid comprising the steps of (i) providing an agitator head assembly in a housing having an inlet and an outlet, where the agitator head assembly includes a top portion and a peripheral wall extending from said top portion defining an inlet space therebetween wherein the peripheral wall includes an outlet channel disposed therein which is in fluid communication with the inlet space in fluid communication with the inlet of the housing and a means for creating cavitation disposed within the outlet channel; (ii) supplying liquid to the inlet of the housing; (iii) rotating the agitator head assembly to create centrifugal forces in the fluid thereby forcing the substance through the cavitation assembly; and (iv) creating cavitation when the fluid passes through the cavitation assembly thereby effectuating mixing of the fluid resulting in a mixed fluid. In this embodiment, the means for rotating said agitator head assembly creates centrifugal forces to cause the mixed fluid to exit the outlet in the housing thereby effectuating pumping the mixed fluid.

The above aspects and other embodiments, features, and advantages of the present invention are more readily understood from a review of the attached drawings and the accompanying specification and claims.

BRIEF DESCRIPTION OF THE DRAWINGS

The invention may take form in various components and arrangements of components. The drawings are only for the purposes of illustrating the preferred and alternate embodiments and are not to be construed as limiting the invention.

DETAILED DESCRIPTION OF THE PREFERRED EMBODIMENTS

Figure 1A:
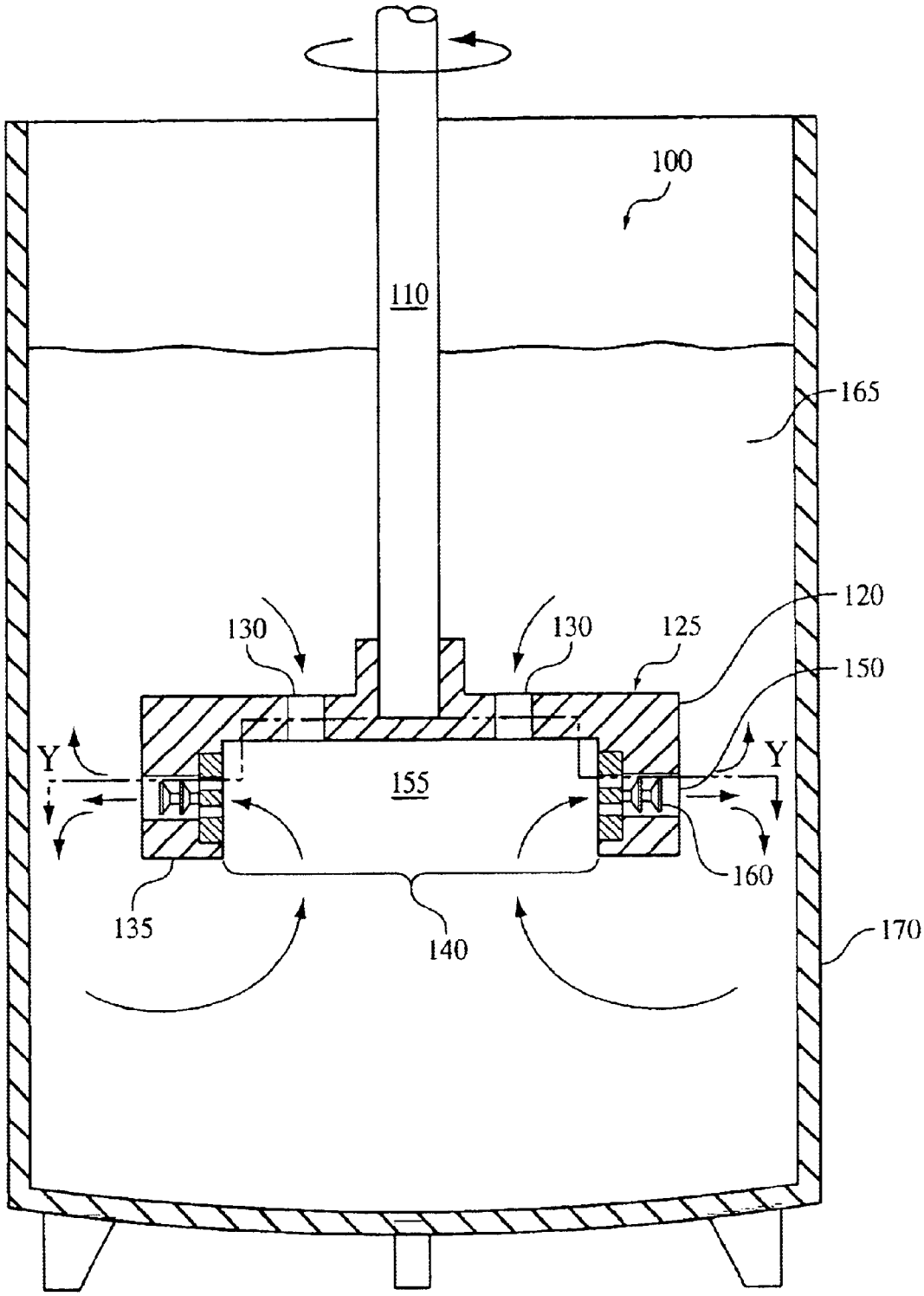
FIG. 1A illustrates a cross-sectional view of a mixer apparatus that suitably practices an embodiment of the invention.

Referring to FIG. 1A, a mixing device 100 according to the present invention includes a shaft 110, an agitator head assembly 120, also known as a rotor or mixer and means for rotating the shaft (not shown). Preferably, agitator head assembly 120 is pressure fitted and fixed to the lower portion of the shaft 110. Although the preferred embodiment utilizes a pressure fitted technique of connecting the agitator head assembly 120 to the shaft 110, it is contemplated that additional connecting techniques could be used to fix the agitator head assembly 120 to the shaft 110. In other embodiments, the agitator head assembly 120 is pinned, glued, welded, threaded, bolted, riveted or the like to the shaft 110. The upper portion of the shaft 110 is connected to a motor (not shown) which when operated, rotates the shaft 110. It is understood that other means of rotating the shaft 110 may be implemented including, but not limited to, pulleys, cranks or the like.

Continued reference to FIG. 1A illustrates the agitator head assembly 120. The agitator head assembly 120 has a generally cylindrically shaped body that includes a base portion 125 and a peripheral wall 145 extending from base portion 125 forming an opening 140 at the end opposite base portion 125. Base portion 125, peripheral wall 145, and opening 140 define an inlet space 155 therebetween. The agitator head assembly 120 has four inlet channels 130 disposed in the base portion 125 of the agitator head assembly 120. The inlet channels 130 and opening 140 are in fluid communication with inlet space 155. It is contemplated and understood that the size, number and location of the inlet channels 130 and opening 140 may vary in alternate embodiments without changing the scope or operation of the present invention.

Figure 1B:
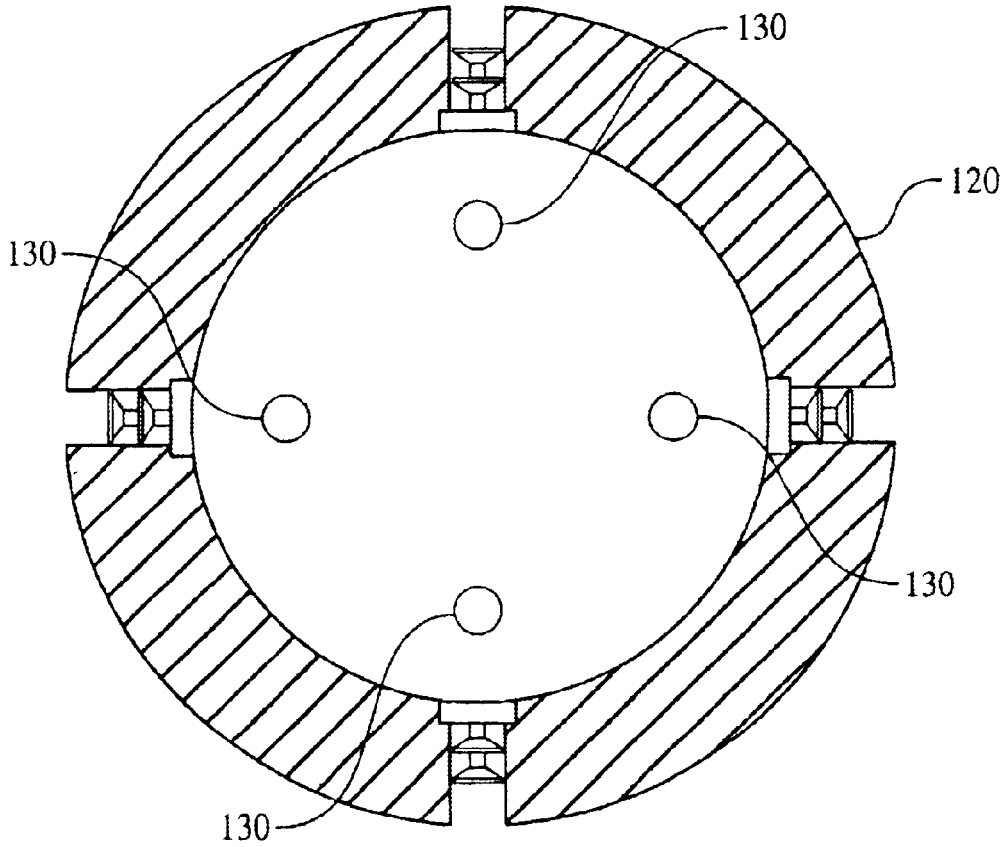
FIG. 1B illustrates a cross-sectional view of an agitator head assembly through axis Y—Y that suitably practices an embodiment of the invention.

FIG. 1B illustrates a cross sectional view of the agitator head assembly 120 through the Y—Y axis of as shown in FIG. 1A.

Again referencing FIG. 1A, the agitator head assembly 120 includes four outlet channels 150 each having a horizontal axis X that are provided in the peripheral wall 145 of agitator head assembly 120 and are in fluid communication with the inlet space 155. Each outlet channel 150 includes a cavitation assembly 160. It is contemplated and understood that the size, number and location of the outlet channels 150 may vary in alternate embodiments without changing the scope or operation of the present invention.

Figure 1C:
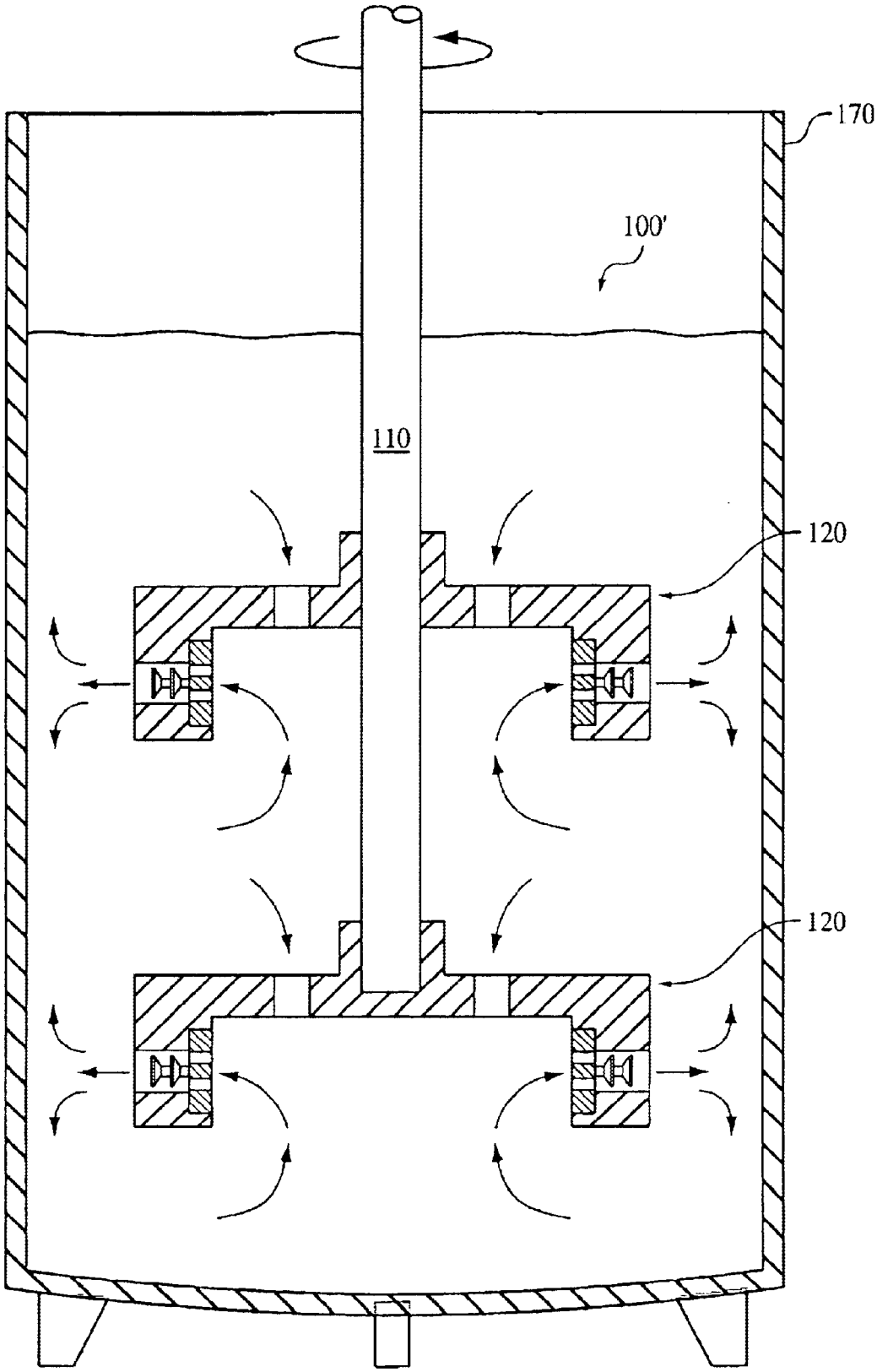
FIG. 1C illustrates a cross-sectional view of a mixer apparatus that suitably practices an alternate embodiment of the invention.

FIG. 1C illustrates an alternate embodiment of the present invention. In this embodiment, the mixing apparatus 100' utilizes two agitator head assemblies 120 connected in series to shaft 110. The general scope and operation of the mixing apparatus 100' is the same as the scope and operation of the mixing apparatus 100 described herein. It is contemplated and understood that additional agitator head assemblies 120 may be incorporated in alternate embodiments without varying the scope or operation of the present invention.

In operation, as illustrated in FIG. 1A, the agitator head assembly 120 is submerged into a volume of liquid 165 contained in tank 170. When agitator head assembly 120 is initially submerged into liquid 165, the liquid 165 enters the agitator head assembly 120 via opening 140 and fills the inlet space 155.

Upon rotation of the shaft 110, the agitator head assembly 120 is likewise rotated in the corresponding direction of the rotation of the shaft 110. This rotation of the agitator head assembly 120 creates centrifugal forces within the liquid 165 situated in the inlet space 155 as illustrated by the arrows in FIG. 1A. These centrifugal forces cause the liquid 165 to enter the outlet channels 150. Because the outlet channels 150 are in fluid communication with the inlet space 155, the liquid enters the cavitation assembly 160 via the outlet channels 150 as illustrated in FIG. 1A. The cavitational mixing occurs within the cavitation assembly 160 positioned within the outlet channel 150.

Figure 2:
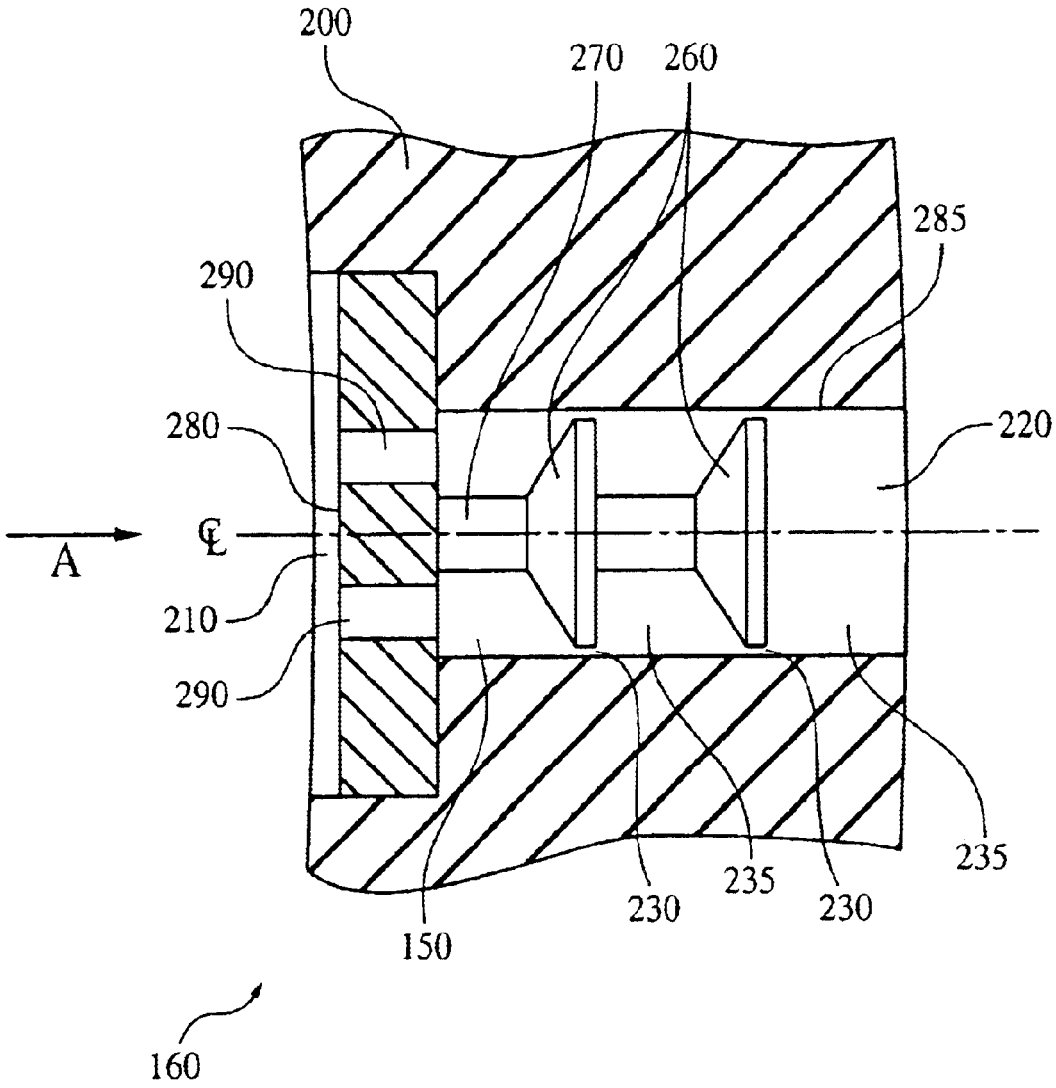
FIG. 2 illustrates a detailed cross-sectional view of a cavitation assembly containing multiple baffle bodies for suitable implementation of an embodiment of the present invention.

FIG. 2 illustrates a detailed cross-sectional view of a two-stage cavitation assembly 160 according to the present invention. Each cavitation assembly 160 is coaxially positioned within outlet channel 150. Each cavitation assembly 160 generally comprises two baffle bodies 260, preferably the shape of a cone, positioned in series on stem 270, which is connected to disk 280 containing orifices 290. Disk 280 is mounted within the peripheral wall 145 and retains baffle bodies 260 inside the outlet channel 150. In place of disk 280 provided with orifices 290 therein, it is possible to use a crosshead, post, propeller or any other fixture which produces a minor loss of pressure. Local constriction 230 of liquid flow is provided between baffle bodies 260 and the interior wall 285 that defines outlet channel 150. The sizes of the local constriction 230 of the liquid flow are set in such a manner so that the cross-section area of the local constriction 230 would be at least 0.3 of the cross-section area of outlet channel 150. However, it is contemplated and understood that the cross-sectional area of the local constriction 230 may vary in additional alternate embodiments without changing the scope or operation of the present invention.

Continued reference to FIG. 2, in the preferred two-stage cavitation assembly 160, the liquid flow, moving along the direction indicated by arrow A flows into the cavitation assembly 160 and around the first baffle body 260. At the first baffle body 260, the liquid flow passes through the first local constriction 230, where the velocity of the liquid flow increases to a minimum velocity dictated by the physical properties of the liquid. The flow velocity in the first local constriction 230 is increased while the pressure is decreased resulting in the formation of cavitation cavities or voids in the flow, which on having been disintegrated, form cavitation bubbles defining the structure of the cavitation field. These cavitation bubbles then enter into a first increased pressure zone 235 resulting from a reduced flow velocity, and collapse. The resulting cavitation effects exert a physiochemical effect on the mixture of liquid components, thus initiating improved mixing, emulsification, homogenization and dispersion.

The flow continues through outlet channel 150 and around the second baffle body 260. At the second baffle body 260, the liquid flow passes through the second local constriction 230, where the velocity of the liquid flow increases to a minimum velocity dictated by the physical properties of the liquid thereby forming cavitation bubbles. Again, beyond the second baffle body 260, the cavitation bubbles enter a second increased pressure zone 235 and thereby collapse enhancing the mixing process. The mixed liquid then exits the outlet channel 150 via outlet 220. After passing through the cavitation the mixed liquid is re-circulated into the original volume of the liquid.

This process is continuously repeated as the agitator head assembly 120 is continuously rotated.

Figure 3A:
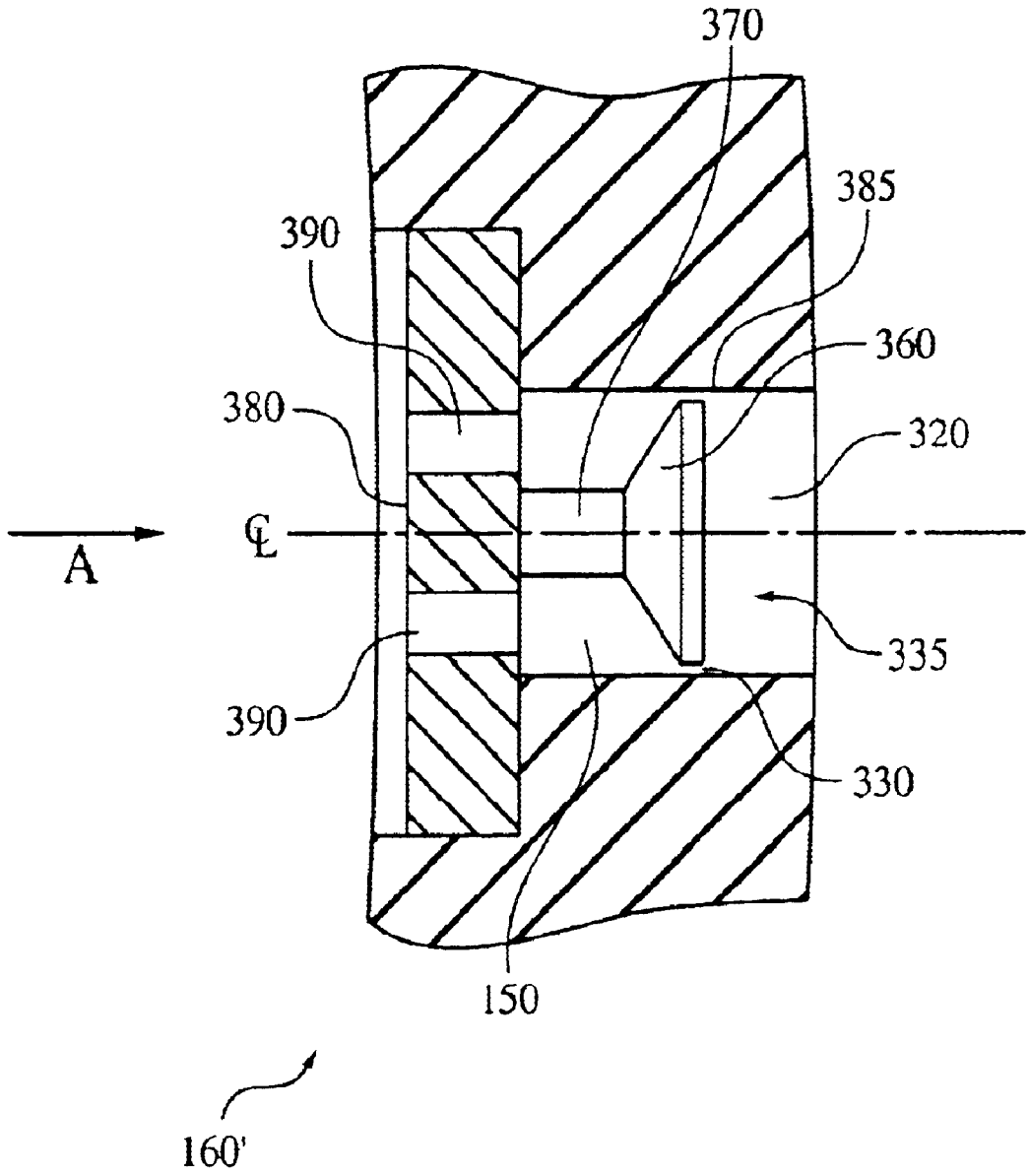
FIG. 3A illustrates a cross-sectional view of a cavitation assembly containing a single baffle body for suitable implementation of an embodiment of the present invention.

In an alternate embodiment as illustrated in FIG. 3A, a single stage cavitation assembly 160' is illustrated. Cavitation assembly 160' generally comprises a baffle body 360, preferably the shape of a cone, which is connected to disk 380 by shaft 370. Disk 380 has orifices 390 disposed therein and is mounted in peripheral wall 145 to retain the baffle body 360 inside the outlet channel 150. In place of disk 380 having orifices 390 disposed therein, it is possible to use a crosshead, post, propeller or any other fixture which produces a minor loss of pressure. A local constriction 330 of liquid flow is provided between baffle body 360 and the interior wall 385 that defines outlet channel 150. The size of the local constriction 330 of the liquid flow is set in such a manner so that the cross-section area of the local constriction 330 would be at least 0.3 of the cross-section area of outlet channel 150. However, it is contemplated and understood that the cross-sectional area of the local constriction 330 may vary in additional alternate embodiments without changing the scope or operation of the present invention.

In operation, centrifugal forces cause the liquid to enter the cavitation assembly 160' in the same manner as described above. The liquid flow, moving along the direction indicated by arrow A flows into the cavitation assembly 160' and around the baffle body 360. At the baffle body 360, the liquid flow passes through the local constriction 330, where the velocity of the liquid flow increases to a minimum velocity dictated by the physical properties of the liquid. The flow velocity in the local constriction 330 is increased while the pressure is decreased resulting in formation of cavitation cavities or voids in the flow, which on having been disintegrated, form cavitation bubbles defining the structure of the cavitation field. These cavitation bubbles then enter into an increased pressure zone 335 resulting in a reduced flow velocity and collapse. The resulting cavitation effects exert a physio-chemical effect on the mixture of liquid components, thus initiating improved mixing, emulsification, homogenization and dispersion. After passing through the cavitation assembly 160', the mixed liquid flows to the outlet 320 and is re-circulated into the original volume of the liquid via outlet 320. This process is continuously repeated as the agitator head assembly 120 is continuously rotated.

In alternate embodiments and in order to control and specify the required structure of the cavitation bubbles field, baffle bodies 260, 360, as illustrated in FIGS. 2 and 3A, may have various shapes, as shown in the corresponding FIGS. 4B–4G and described in U.S. Pat. Nos. 5,810,052 and 5,937,906 both of which are hereby incorporated by reference in their entireties herein.

Figure 3B:
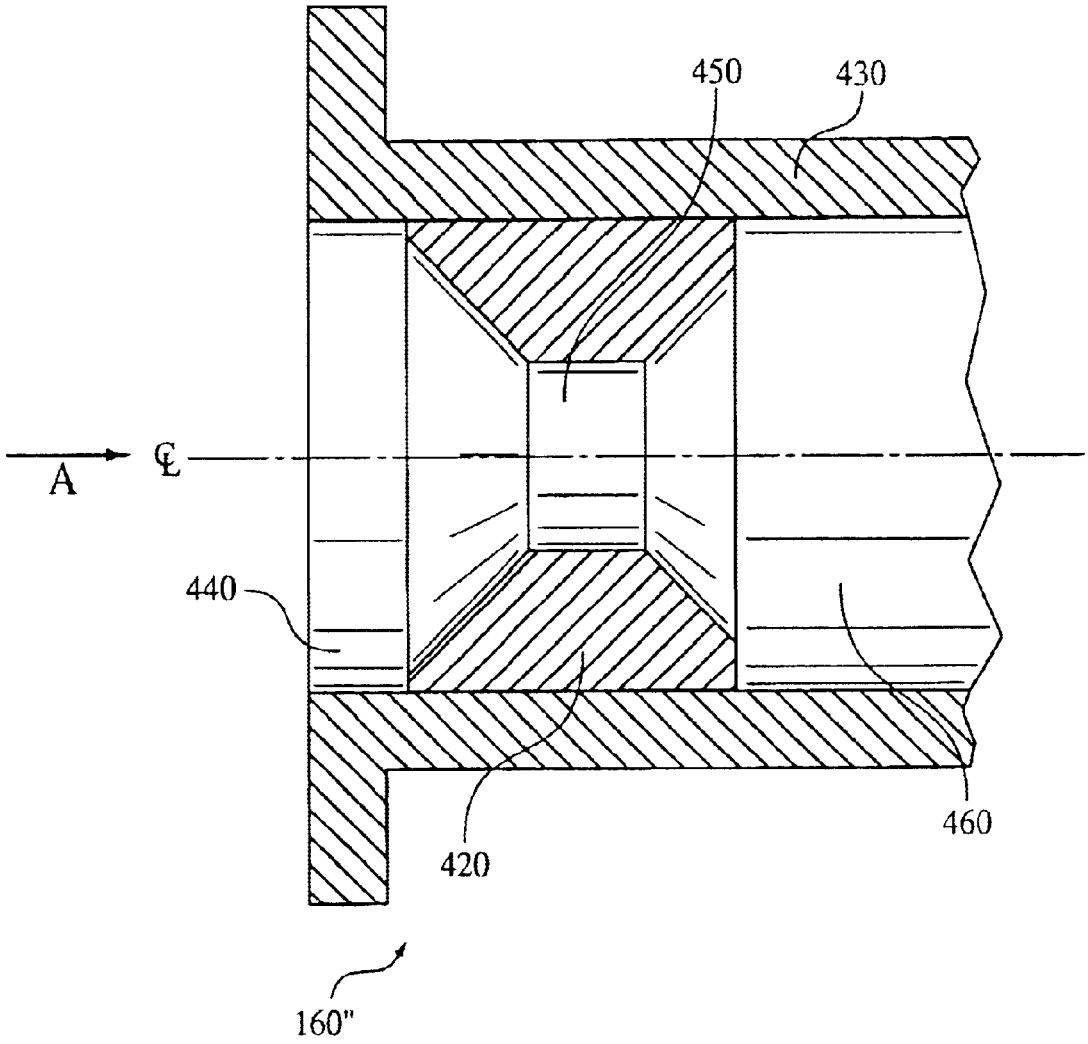
FIG. 3B illustrates a cross-sectional view of a cavitation assembly containing a baffle with a transit channel in the shape of a Venturi tube for suitable implementation of an embodiment of the present invention.

Referring now to FIG. 3B, another alternative embodiment of the cavitation assembly 160" is illustrated. This alternate design is intended for the accomplishment of the same method of mixing as described above.

In the cavitation assembly 160", baffle 420 is positioned inside outlet channel 150 after inlet 440. Baffle 420 includes transit channel 450 in its own body, which is carried out in the shape of a Venturi tube. This transit channel 450 produces a local constriction of the liquid flow.

In operation, centrifugal forces cause the liquid to enter the cavitation assembly 160" in the same manner as described above. The liquid flow, moving along in the direction as indicated by arrow A is throttled through the transit channel 450 at a velocity sufficient to generate cavitation thereby producing cavitation bubbles. An increased pressure zone 460 is created thereby producing a cavitation cavern wherein the cavitation bubbles collapse effectuating the mixing process. As described in previous embodiments, these cavitation effects provide improved mixing, emulsification, homogenization and dispersion.

Additionally, the transit channel 450, as illustrated in FIG. 3B, may have various shapes that produce the local constriction of the flow in the baffle 420, as shown in FIGS. 5A–5E and described in U.S. Pat. Nos. 5,810,052 and 5,937,906. Moreover, utilizing such local constriction of flow designs (FIGS. 3B, 5A–5F) are preferred during the mixing of smaller liquid volumes, and also for the mixing of liquid mediums containing sufficiently large hard material particles.

With reference to FIGS. 2, 3A, and 3B, the shape of the outlet channel 150 does not essentially exert influence on the effectiveness of the mixing process. However, from the point of view of its manufacturability, in fabricating the device for the realization of the referenced method, it is preferred to utilize an outlet channel 150 that has a circular, rectangular, or polygonal shape. Outlet channel 150 may also have a cross section that has one linear section and a circular or irregularly shaped cross section, such as a semi-circle.

Figure 4A:
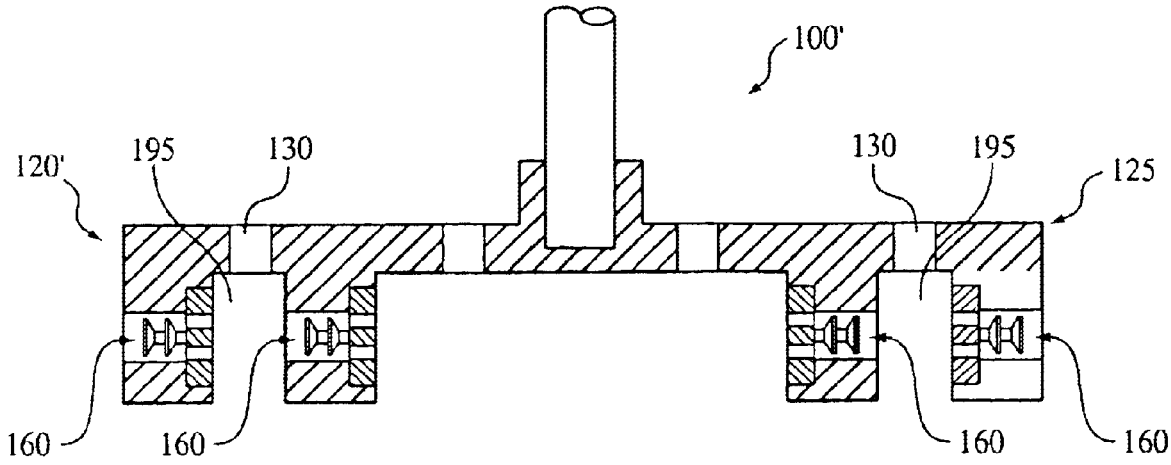
FIG. 4A illustrates a cross-sectional view of an agitator head assembly containing multiple cavitation assemblies for suitable implementation of an alternate embodiment of the present invention.

FIG. 4A illustrates another embodiment of the present invention. In this embodiment, mixing device 100' comprises an agitator head assembly 120' that is equipped with two cavitation assemblies 160 in series separated by an open space. Preferably, agitator head assembly 120' includes four more inlet channels 130 provided in the top portion 125 of agitator body assembly 120' and in fluid communication with channel 195. The general scope and operation of the invention is the same as the scope and operation as described for previous embodiments. It is contemplated and understood that additional cavitation assemblies 160 may be incorporated in alternate embodiments without varying the scope or operation of the present invention.

Figure 5G:
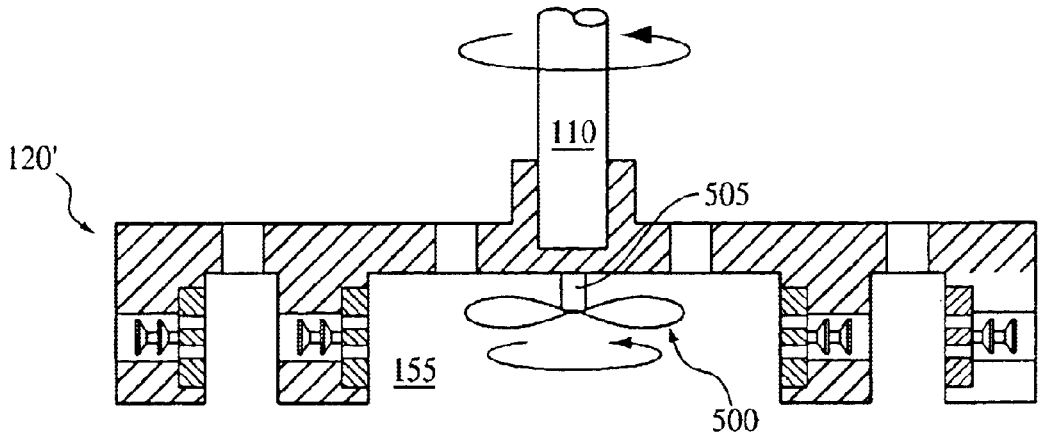
FIG. 5G illustrates a cross-sectional view of an agitator head assembly containing multiple cavitation assemblies and an impeller for suitable implementation of an alternate embodiment of the present invention.
Figures 4B, 4C, 4D, 4E, 4F, 4G:
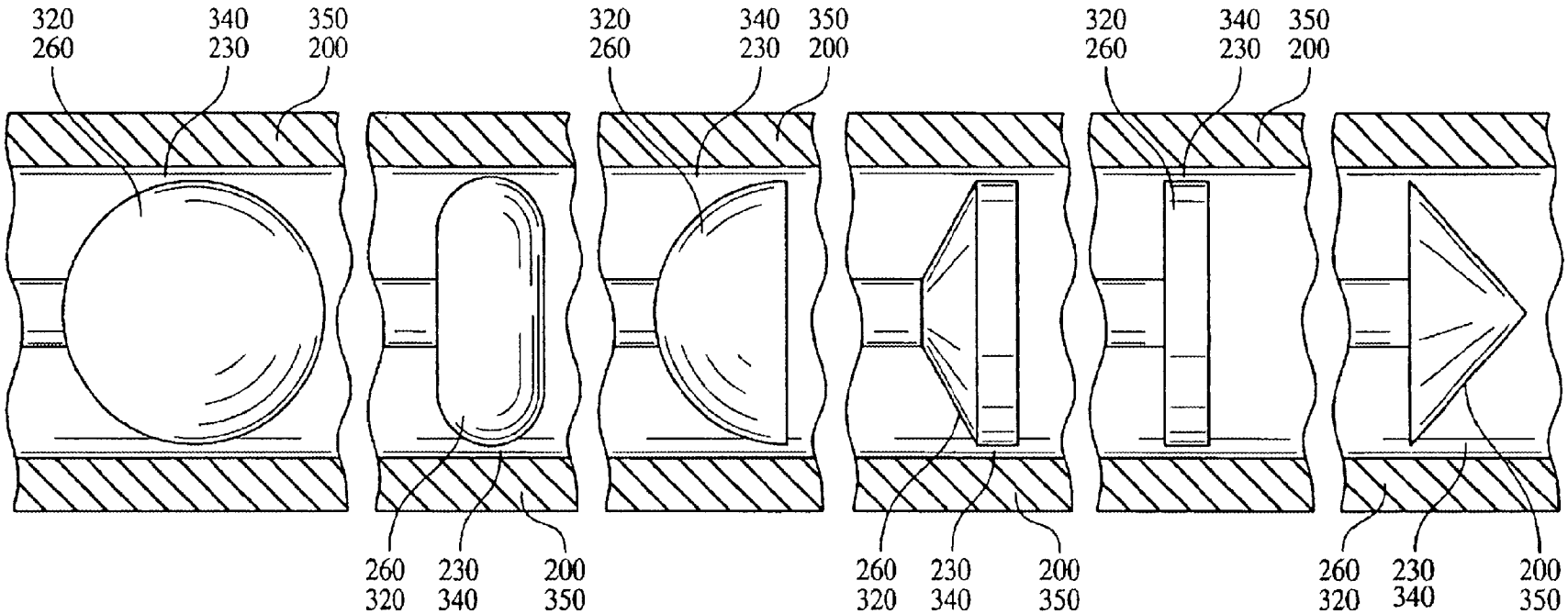
FIGS. 4B–4G are fragmented views of the longitudinal section of the local flow constriction in the apparatus according to FIGS. 2 and 3A which are formed of baffle bodies of various shapes.
Figures 5A, 5B, 5C, 5D, 5E, 5F:
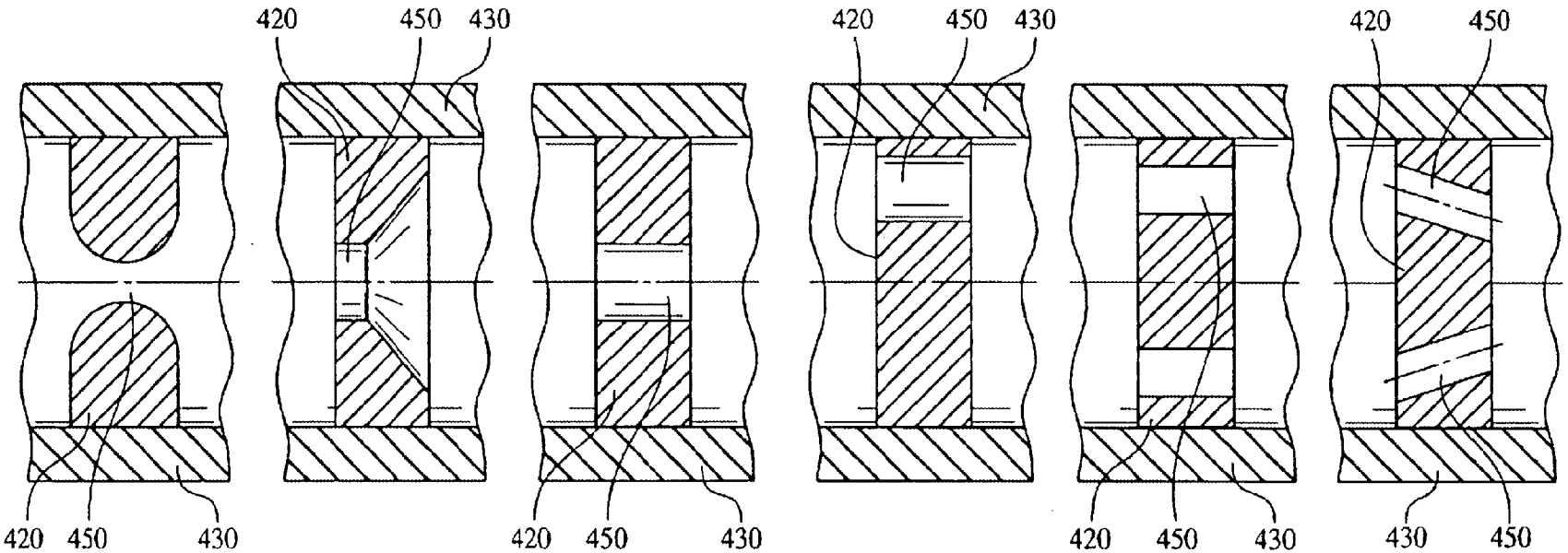
FIGS. 5A–5F are fragmented views of the longitudinal section of the local flow constriction in the apparatus according to FIG. 3B which are formed of baffles having one or several channels of various shapes.

FIG. 5G illustrates yet another embodiment of the present invention incorporating an impeller 500 into the inlet space 155 of agitator head assembly 120'. Impeller 500 is connected by shaft 505 to agitator head assembly 120' and thus will be rotated at the same rate as the shaft 110. An artisan can appreciate that the rotation of the impeller 500 will create and likewise enhance the centrifugal forces within the liquid during rotation. Although preferably impeller 500 is constructed from aluminum, it is contemplated that other suitable materials may be used including but not limited to, alloys, plastics, composites or the like. The impeller 500 as shown in FIG. 5G may be utilized with the embodiments described herein as well as with additional alternate embodiments of the present invention.

Figure 6:
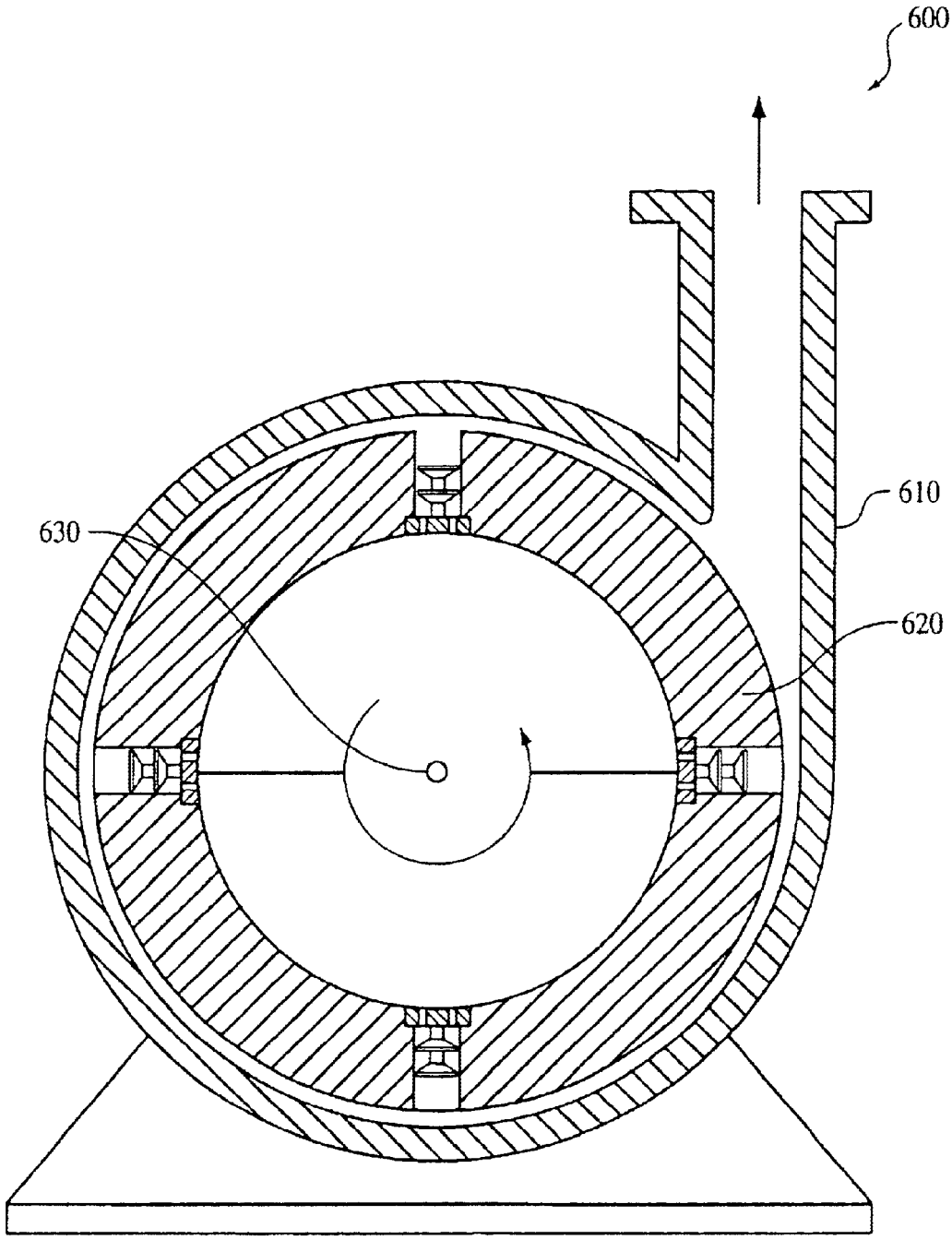
FIG. 6 illustrates a cross-sectional view of a pump apparatus that suitably practices an embodiment of the invention.
Figure 7:
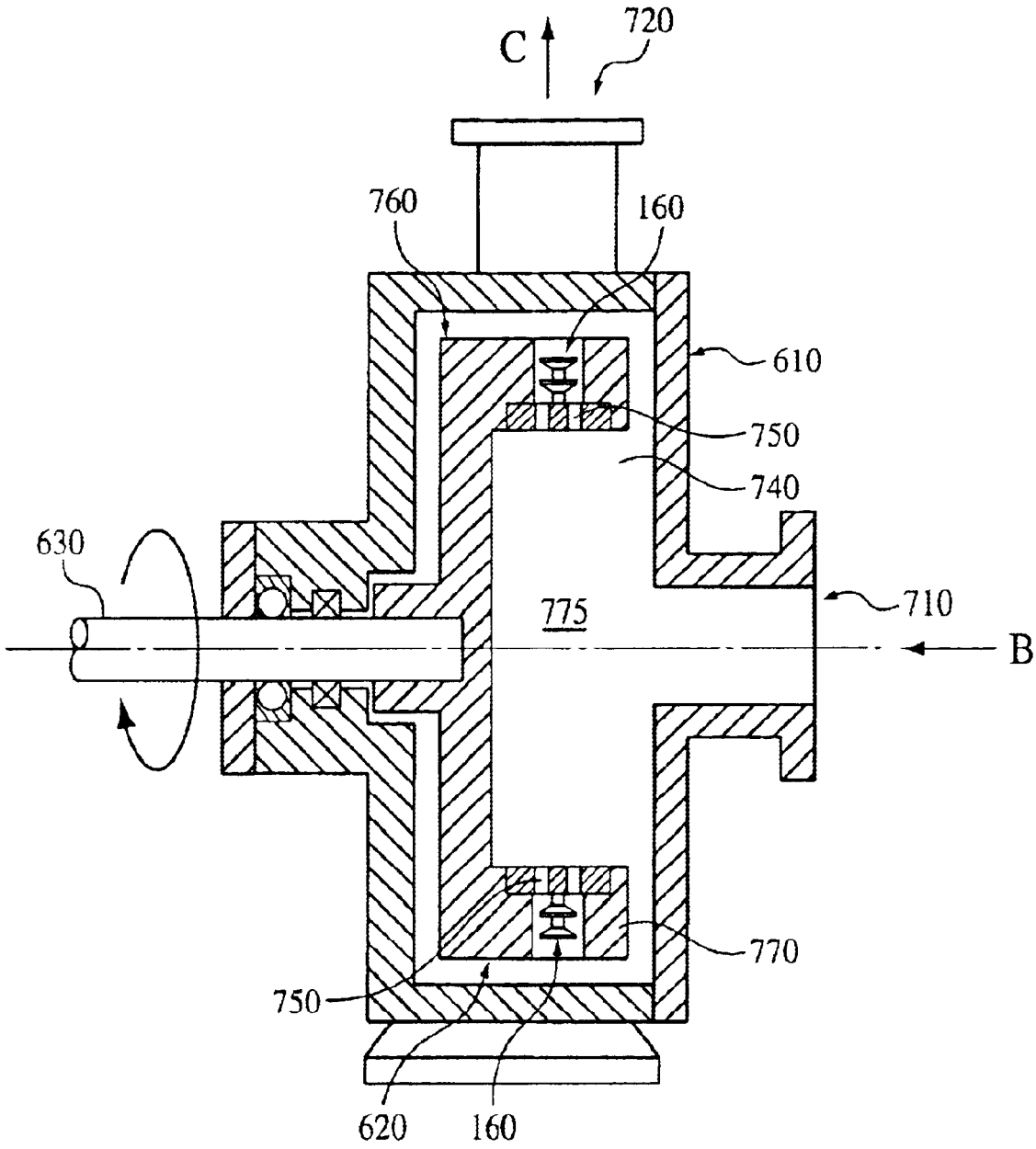
FIG. 7 illustrates a cross-sectional side view of a pump apparatus that suitably practices an embodiment of the invention.

In another embodiment, the present invention provides for an apparatus 600 that has mixing and pumping capabilities as illustrated in FIGS. 6 and 7. Generally, apparatus 600 includes a pump housing 610, an agitator head assembly 620, a drive shaft 630 and a means for rotating the drive shaft (not shown).

Referring now to FIG. 7, the pump housing 610 is equipped with an inlet orifice 710 and an outlet orifice 720. A liquid supply (not shown) is connected to inlet orifice 710 to provide liquid flow from the liquid supply (not shown) to the inlet orifice 710. The pump housing 610 is preferably constructed of metal however, it is contemplated that other suitable materials may be used including but not limited to, alloys, plastics, composites or the like. The interior portion of pump housing 610 preferably has a shape complimentary to the shape of the agitator head assembly 620.

As illustrated, in this embodiment, the agitator head assembly 620 is positioned inside the pump housing 610 and is connected to the rotating means (not shown) via a drive shaft 630.

Agitator head assembly 620 is pressure fitted and fixed to one end of the drive shaft 630. Although the embodiment utilizes a pressure fitted technique of connecting the agitator head assembly 620 to the drive shaft 630, it is contemplated that additional connecting techniques could be used to fix the agitator head assembly 620 to the drive shaft 630. In other embodiments, the agitator head assembly 620 is pinned, glued, welded, threaded, bolted, riveted or the like to connect the agitator head assembly 620 to the drive shaft 630. The drive shaft 630 is connected to a motor (not shown) which when operated, rotates the drive shaft 630. It is understood that other means of rotating the drive shaft 630 may be implemented including, but not limited to, pulleys, cranks or the like.

Continued reference to FIG. 7 illustrates an agitator head assembly 620 that has a generally cylindrically shaped body that includes a base portion 760 and a peripheral wall 770 that extends from base portion 760 forming an opening 740 at the end of the body opposite base portion 760. Base portion 760, peripheral wall 770 and opening 740 define an inlet space 775 therebetween. Preferably, opening 740 faces the inlet orifice 710 of the pump housing 610 opposite the connection of the drive shaft 630. Opening 740 is in fluid communication with inlet space 775. It is contemplated and understood that the size and location of opening 740 may vary in additional alternate embodiments without changing the scope or operation of the present invention.

Still referencing FIG. 7, the agitator head assembly 620 preferably includes four outlet channels 750 that are provided in the peripheral wall 770 of said agitator head assembly 620 and are in fluid communication with the inlet space 775. Each outlet channel 750 includes one cavitation assembly 160. It is contemplated and understood that the size, number and location of outlet channels 750 may vary in alternate embodiments without changing the scope or operation of the present invention.

FIG. 2 illustrates a detailed cross-sectional view of a two-stage cavitation assembly 160 according to the present invention. Each cavitation assembly 160 is coaxially positioned within outlet channel 150. Each cavitation assembly 160 generally comprises two baffle bodies 260, preferably the shape of a cone, positioned in series on stem 270, which is connected to disk 280 containing orifices 290. Disk 280 is mounted within the peripheral wall 145 and retains baffle bodies 260 inside the outlet channel 150. In place of disk 280 provided with orifices 290 therein, it is possible to use a crosshead, post, propeller or any other fixture which produces a minor loss of pressure. Local constriction 230 of liquid flow is provided between baffle bodies 260 and the interior wall 285 that defines outlet channel 150. The sizes of the local constriction 230 of the liquid flow are set in such a manner so that the cross-section area of the local constriction 230 would be at least 0.3 of the cross-section area of outlet channel 150. However, it is contemplated and understood that the cross-sectional area of the local constriction 230 may vary in additional alternate embodiments without changing the scope or operation of the present invention.

Although the cavitation assembly 160 illustrated in FIGS. 6 and 7 includes two baffle bodies, one skilled in the art would recognize that one baffle body may be utilized as described above and shown in FIG. 3A or that cavitation assembly 160 may take the form of a Venturi table as described above and shown in FIG. 3B.

In alternate embodiments and in order to control and specify the required structure of the cavitation bubbles field, baffle bodies 260, 360, as illustrated in FIGS. 2 and 3A, may have various shapes, as shown in the corresponding FIGS. 4B–4G.

Additionally, the transit channel 450, as illustrated in FIG. 3B, may have various shapes that produce the local constriction of the flow in the baffle 320, as shown in FIGS. 5A–5F. Moreover, utilizing such local constriction of flow designs (FIGS. 3B, 5A–5F) are preferred during the mixing of smaller liquid volumes, and also for the mixing of liquid mediums containing sufficiently large hard material particles.

In operation, liquid is first supplied to pump housing 610 via inlet 710 and enters inlet space 775. Upon rotation of the drive shaft 630, the agitator head assembly 620 is likewise rotated in the corresponding direction of the rotation of the drive shaft 630. This rotation creates centrifugal forces within the liquid in inlet space 775 thereby causing the liquid to enter the outlet channels 750. Because the outlet channels 750 are in fluid communication with the inlet space 775, the liquid enters the cavitation assembly 160 via the outlet channels 750 thereby creating cavitation in the same manner as described above thus effectuating mixing of the liquid. In combination with the mixing as described above, apparatus 620 provides for pumping of the liquid wherein the centrifugal forces caused by the rotation of the agitator head assembly 620 forces the mixed liquid to exit the pump housing 610 via outlet 720.

Although the present invention has applications in mixing and pumping, one skilled in the art would appreciate that the present invention may be utilized as a reactor to enhance and expedite chemical reactions.

The invention has been described with reference to the preferred embodiments and selected alternate embodiments. Modifications and alterations will become apparent to persons ordinarily skilled in the art upon reading and understanding the preceding detailed description of the invention. It is intended that the invention be construed as including all such alterations and modifications insofar as they come within the scope of the appended claims or the equivalence thereof.

Having thus set forth the preferred embodiments, the invention is now claimed to be:

1. A mixing device comprising:

a body including a base portion and a peripheral wall extending from the base portion defining an inlet space therebetween;

the base portion includes at least one inlet port disposed therein which is in fluid communication with the inlet space;

the peripheral wall includes at least one outlet channel disposed therein which is in fluid communication with the inlet space; and at least one baffle body disposed in and spaced apart from the outlet channel to provide a local constriction between the baffle body and the outlet channel.

2. The mixing device as set forth in claim 1, further comprising a shaft connected coaxial to the base portion of the body opposite the peripheral wall.

3. The mixing device as set forth in claim 2, further comprising means for rotating the shaft.

4. The mixing device as set forth in claim 3, wherein the rotating means is a motor.

5. The mixing device as set forth in claim 1, wherein the body has a generally cylindrical shape.

6. A mixing device comprising:

a housing having an inlet configured to introduce a fluid into the housing and an outlet configured to permit fluid to exit the housing;

a mixing head disposed within the housing, the mixing head including:

a base portion and a peripheral wall extending from the base portion defining an inlet space therebetween, the peripheral wall includes an outlet channel disposed therein that is in fluid communication with the inlet space, the inlet space is in fluid communication with the inlet of the housing, and at least one baffle body coaxially disposed in and spaced apart from the outlet channel to provide a local constriction between the baffle body and the outlet channel; and means for rotating the mixing head within the housing.

7. The device as set forth in claim 6, wherein the inlet is disposed perpendicular to outlet.

8. The device as set forth in claim 6, wherein the rotating means is a motor.

9. A method for mixing a fluid comprising:

inserting a mixing head into a volume of fluid, the mixing head including:

a base portion and a peripheral wall extending from the base portion defining an inlet space therebetween, the peripheral wall includes an outlet channel disposed therein that is in fluid communication with the inlet space, and at least one baffle body coaxially disposed in and spaced apart from the outlet channel to provide a local constriction between the baffle body and the outlet channel;

rotating the mixing head to create centrifugal forces to force the fluid through the local constriction thereby creating cavitation to effectuate mixing of the fluid.

10. A method for mixing and pumping a fluid comprising:

providing a mixing head in a housing having an inlet and an outlet, the mixing head including:

a base portion and a peripheral wall extending from the base portion defining an inlet space therebetween, the peripheral wall includes an outlet channel disposed therein that is in fluid communication with the inlet space, the inlet space is in fluid communication with the inlet of the housing, and at least one baffle body coaxially disposed in and spaced apart from the outlet channel to provide a local constriction between the baffle body and the outlet channel;

supplying fluid to the inlet of the housing; and rotating the mixing head to create centrifugal forces in the fluid to:

i) force the fluid through the local constriction thereby creating cavitation to effectuate mixing of the fluid, and ii) force the mixed fluid to exit the outlet in the housing thereby effectuating pumping of the mixed fluid.

* * * * *